United States Patent [19]

Chibana

[11] 4,215,614

[45] Aug. 5, 1980

[54] ELECTRONIC MUSICAL INSTRUMENTS OF HARMONIC WAVE SYNTHESIZING TYPE

[75] Inventor: Masanobu Chibana, Hamamatsu, Japan

[73] Assignee: Nippon Gakki Seizo Kabushiki Kaisha, Hamamatsu, Japan

[21] Appl. No.: 964,946

[22] Filed: Nov. 30, 1978

[30] Foreign Application Priority Data

Dec. 13, 1977 [JP] Japan ..... 52-148857

[51] Int. Cl.[2] ..... G10H 1/00

[52] U.S. Cl. ..... 84/1.01; 84/1.22

[58] Field of Search ..... 84/1.01, 1.03, 1.23, 84/1.22; 364/754, 760

[56] References Cited

U.S. PATENT DOCUMENTS

| | | | |
|---|---|---|---|
| 3,610,901 | 10/1971 | Lynch | 364/724 |
| 3,809,786 | 5/1974 | Deutsch | 84/1.03 |
| 3,888,153 | 6/1975 | Deutsch | 84/1.03 |
| 3,929,053 | 12/1975 | Deutsch | 84/1.24 |
| 3,951,030 | 4/1976 | Deutsch | 84/1.25 |
| 4,000,675 | 1/1977 | Futamase et al. | 84/1.01 |

*Primary Examiner*—Gene Z. Rubinson
*Assistant Examiner*—Forester W. Isen
*Attorney, Agent, or Firm*—Charles E. Pfund

[57] ABSTRACT

There are provided a plurality of key switches which respectively designate the pitches of the musical tones to be generated, a frequency number generator which generates frequency numbers corresponding to the respective key switches, a harmonic order number generator which generates harmonic order numbers representing the orders of the respective harmonic components, an arithmetic processor for producing a multiplication product of the frequency number and the harmonic order number, an accumulator which repeatedly accumulates the output of the arithmetic processor of each harmonic order at a predetermined speed, and a sinusoid table including a memory device storing the amplitude values at respective sampling points of a sinusoidal wave for generating the amplitude values of the sinusoidal wave corresponding to respective harmonic components thereby producing the harmonic components.

3 Claims, 5 Drawing Figures

ELECTRONIC MUSICAL INSTRUMENTS OF HARMONIC WAVE SYNTHESIZING TYPE

BACKGROUND OF THE INVENTION

This invention relates to the improvement of an electronic musical instrument of the harmonic wave synthesizing type therein a fundamental wave (fundamental tone) and its harmonic components (harmonic overtones) corresponding to the tone pitch of a depressed key are produced, the fundamental wave and the harmonic components are respectively multiplied with corresponding coefficients, and the products are added together to form a musical tone.

According to one type of the harmonic wave synthesizing type electronic musical instrument, a musical tone is obtained by sequentially calculating the amplitude values at successive sampling points of a musical tone waveform according to the following equation $$x_0(qR) = \sum_{n=1}^{N/2} C_n \sin \frac{\pi}{W} nqR$$

where q=1, 2, 3, . . .

- $x_0(qR)$ . . . amplitude value at successive sampling point of the musical tone waveform
- R . . . a value proportional to the frequency (tone pitch) of the musical tone to be produced (hereinafter termed a "frequency number")
- n . . . the order of the harmonics including the fundamental wave
  - n=1 means the fundamental wave (fundamental tone)
  - n=2 means the second harmonic wave (the second harmonic overtone)
  - n=3 means the third harmonic wave (the third harmonic overtone)
- $C_n$ . . . amplitude coefficients of the harmonic components of respective orders (Fourier coefficient)
- N . . . number of the sampling points of the musical tone waveform
- W . . . number of the harmonics (overtones) involved in the amplitude calculation at successive sampling points W=N/2

An electronic musical instrument of the harmonic synthesizing type is disclosed, for example, in U.S. Pat. No. 3,809,786 invented by Ralph Deutsch and issued on May 7, 1974.

According to such an electronic musical instrument of a harmonic wave synthesizing type, a frequency number R corresponding to the tone pitch of a depressed key is generated, the frequency number R is sequentially accumulated each time a timing signal $t_x$ for determining a computation time is generated to obtain an accumulated value qR that sequentially designates the sampling points (phase angles) of the musical tone waveform, and the accumulated value qR is sequentially accumulated at the timing of a clock pulse to obtain a further accumulated value nqR which is used to produce (read out from the table) the sinusoidal wave amplitude value sin $\pi$/W nqR of each harmonic wave at successive sampling points. Accordingly, in the musical tone generated in this manner, the frequencies (period) of respective harmonics (including the fundamental wave) have a relation of interger multiples (harmonic overtones), thus producing a harmonic musical tone.

In the musical tone generated by the conventional natural musical instruments, however, the frequencies of respective harmonics are not integer multiples of the frequency of the fundamental wave (the first harmonic), that is the musical tone is not precisely harmonic thus producing a tone rich in naturality.

With the prior art electronic musical instrument of the harmonic wave synchronizing type described above it has been difficult to generate non-harmonic musical tones. Although U.S. Pat. No. 3,888,153 discloses an electronic musical instrument of a harmonic wave synthesizing type that can produce non-harmonic musical tones, in this patent is it necessary to add a new value to the accumulated value as an overtone offset value so that the construction is complicated. Moreover, it is impossible to set the overtone offset values of respective orders (respective harmonics) to any desired values to obtain desired non-harmonic property (inharmonicity).

In electronic musical instruments, for the purpose of controlling the pitch of the generated musical tones for obtaining various effects, such pitch controls as vibrato, glide, portamento, etc. have been used.

However, in order to provide the pitch control for the prior art electronic musical instrument of the harmonic wave synthesizing type, it is necessary to multiply the frequency number R comprising about 15 bits with a signal for effecting the pitch control. Such multiplying operation not only complicates the circuit construction but also requires a long time for the multiplying operation.

SUMMARY OF THE INVENTION

Accordingly, it is an object of this invention to provide a novel electronic musical instrument of the harmonic wave synthesizing type which can readily generate non-harmonic musical tones.

Another object of this invention is to provide an electronic musical instrument of the harmonic wave synthesizing type capable of readily producing not only the non-harmonic musical tones but also harmonic musical tones.

Still another object of this invention is to provide an electronic musical instrument of the harmonic wave synthesizing type capable of effecting the pitch control of the generated musical tones with a simple construction.

According to this invention, these and further objects can be accomplished by producing a frequency number R corresponding to each key and harmonic order numbers n which represent the orders of respective harmonics, arithmetically processing the frequency number R and the harmonic order number n to obtain a signal nR, and repeatedly accumulating signal nR for each harmonic order to form an accumulated value utilized to sequentially reading out the amplitude value of the harmonic wave at respective sampling points of the generated musical tone. Each harmonic order number n is made to have an integer multiple relationship or to be slightly deviated therefrom so as to readily produce harmonic and non-harmonic musical tones.

According to this invention there is provided an electronic musical instrument of a harmonic wave synthesizing type wherein the harmonic components of a musical tone are generated, the harmonic components are multiplied with corresponding amplitude coefficients respectively, and the products are added together to synthesize the musical tone, and which instrument is provided with a plurality of key switches for determining the pitch of the musical tone, frequency number generating means which generates frequency numbers corresponding to the respective key switches, harmonic order number generating means which generates harmonic order numbers representing the orders of the respective harmonic components, an arithmetic processing means for obtaining a multiplication product of the frequency number and the harmonic order number, accumulating means for repeatedly accumulating the output of the arithmetic processing means for respective orders at a predetermined speed, and sinusoid table means including a memory device which stores the amplitude values at respective sampling points of a sinusoidal wave for generating the amplitude values of the sinusoidal wave corresponding to respective ones of the harmonic components in response to the accumulated values of respective harmonic orders produced by the accumulating means, thereby producing the harmonic components.

In the electronic musical instrument described above the frequency number and the harmonic order number are logarithms, and the arithmetic processing means includes an adder which adds together the logarithms and a logarithm-to-natural number converter which converts the outputs of the adder into natural numbers.

According to a modified embodiment of this invention, there are further provided means for producing such musical tone pitch signals as the frequency number R and the harmonic order number n, and various tone pitch control signals as the guide, portamento and vibrato control signals in the form of logarithmic signals and an adder for adding together the logarithmic frequency number R, the logarithmic higher harmonic order number n, and various logarithmic pitch control signals thereby enabling to perform arithmetic processings necessary to control the pitch of the generated musical tone by using a simple adder instead of a complicated multiplier.

DESCRIPTION OF THE PREFERRED EMBODIMENTS

Figure 1:
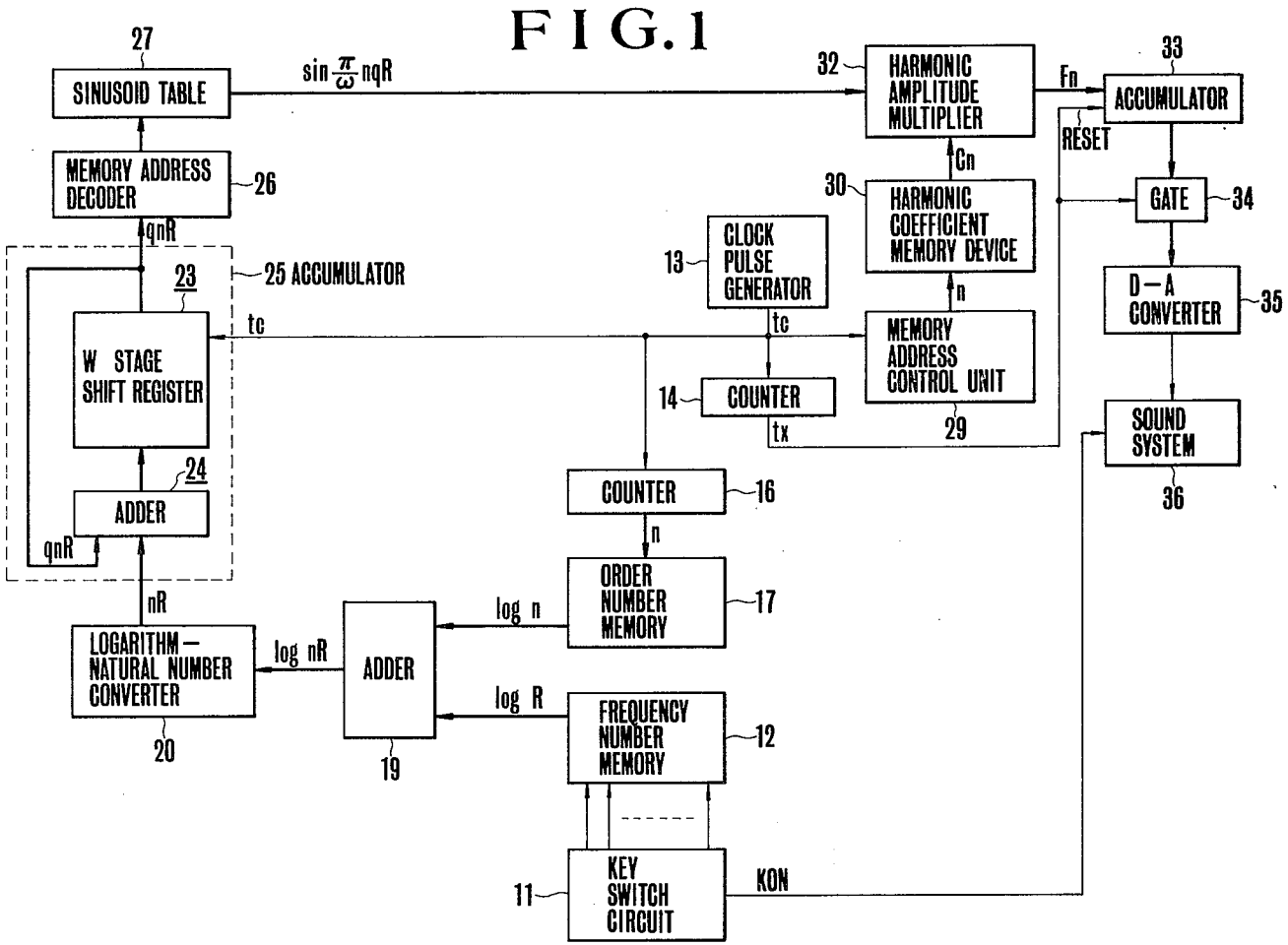
FIG. 1 is a block diagram showing one embodiment of the electronic musical instrument of a harmonic wave synthesizing type according to this invention.

A preferred embodiment of this invention shown in FIG. 1 comprises a key switch circuit 11 provided for a keyboard, not shown, and including key switches corresponding to respective keys of the keyboard. The key switch circuit 11 is constructed to produce a signal having a logic value "1" on its output line when the associated key is depressed. The key switch circuit contains a monophonic preferential circuit so as to produce the signal "1" only on an output line corresponding to a key switch having a highest order of preference when two or more keys are depressed at the same time. The output lines corresponding to respective key switches of the key switch circuit 11 are connected to the inputs of a frequency number memory device 12 stores the frequency numbers R corresponding to the tone pitches of the keys. The frequency number memory device 12 stores the frequency numbers R corresponding to the tone pitches of respective keys in terms of log R (this value is hereinafter termed a logarithmic frequency number). Accordingly, when a given key is depressed, the frequency number memory device 12 is addressed by an output of the key switch circuit 11 to read out a logarithmic frequency number log R corresponding to the tone pitch of the depressed key.

A clock pulse generator 13 is provided to produce a clock pulse $t_c$ having a definite frequency. The frequency of the clock pulse is divided by W by a counter 14 to form a timing signal $t_x$ for calculating or computing time interval. W represents the total number of the harmonics to be synthesized. Where it is desired to synthesize up to the 16th harmonic, W=16. In the following description the term "harmonic" also includes the fundamental wave (fundamental tone) which corresponds to the first harmonic. The computation interval timing signal $t_x$ is applied to an accumulator to be described later. Furthermore, the clock pulse $t_c$ generated by the clock pulse generator 13 is supplied to a counter 16 having a modulo W and generates a harmonic order signal n (n=1–W) which represents the orders of respective harmonics by counting the number of the clock pulses. The output is supplied to an order number device 17 which produces the order numbers $n_1$ through $n_W$ by being addressed by the harmonic order signal produced by the counter 16. Thus, the addresses of the order number memory device 17 stores the order numbers $n_1$ through $n_W$ corresponding to the orders of respective harmonics in terms of logarithms log $n_1$–log $n_W$. Generally, log $n_1$–log $n_W$ are expressed as log n ($n=n_1-n_W$) and termed logarithmic order numbers. An adder 19 adds together the logarithmic frequency numbers log R produced by the frequency number memory device 12 and the logarithmic order numbers log n produced by the order number memory device 17 to produce an output log nR which is applied to a logarithm-to-natural number converter 20 which converts log nR into a natural number nR. There are also provided a W stage shift register 23 which is shifted in accordance with the clock pulse $t_c$ and an adder 24 which adds together the output nR of the logarithm-to-natural number converter 20 and the output nqR of the shift register 23 for supplying its sum (nR+qnR) to the input (first stage) of the shift register 23. The output nR of the logarithm-to-natural number converter 20 and the output qnR of the shift register 23 which are applied to the adder 24 relate to the same order number (one of $n_1-n_W$) and they are generated synchronously. Consequently, the shift register 23 and the adder 24 constitute an accumulator 25 which sequentially accumulates the output nR ($n_1R-n_WR$) of the logarithm-to-natural number converter 20 at each order number ($n_1-n_W$) to obtain an accumulated value qnR ($qn_1R-qn_WR$).

The accumulated value qnR (1nR, 2nR, 3nR, . . . ) produced by the accumulator 25 is supplied to a memory address decoder 26 to be added thereby. The decoded signal is applied to a sinusoid table memory device 27, the addresses decoder 26 to be decoded thereby. The decoded signal is applied to a sinusoid table memory device 27, the addresses thereof storing amplitude values of successive sampling points in one period of a sinusoidal waveform. A sinusoidal wave amplitude value sin $\pi/W$ nqR is read out from the sinusoid table 27 on the time division basis.

As can be noted from the foregoing description, the accumulated value qnR of the accumulator 25 represents the phase of the n-th harmonic at successive sampling points now being calculated or computed. As a consequence, the sinusoid table 27 successively produces the sinusoidal wave amplitude values sin $\pi/W$ nqR ($n=1,2,\ldots,W$) of respective harmonics (including the fundamental wave) at a given sampling point in the order of the fundamental wave (the first harmonic), the second harmonic, . . . the W-th harmonic.

The memory address control unit 29 comprises a modulo counter which sequentially counts the number of clock pulses $t_c$ in synchronism with the counter 14 for applying its count value to a harmonic coefficient memory device 30 to act as an address signal n. Harmonic amplitude coefficients $C_n$ corresponding to the amplitude values of respective harmonics suitable for obtaining desired tone color of the musical tone are stores in respective addresses of the harmonic coefficient memory device 30. When an address signal n (which represents the order of the harmonic) which sequentially varies the synchronism with the clock pulse $t_c$ is supplied from the memory address control unit 29, the harmonic coefficients $c_n$ which set the amplitude values of respective harmonics are sequentially read out and then applied to a harmonic amplitude multiplier 32 which multiplies the sinusoidal wave amplitude value sin $\pi/W$ nqR of each harmonic read out from the sinusoid table 27 on the time division basis at each sampling point with the harmonic amplitude coefficient $C_n$ individually set for each harmonics. The product $F_n=C_n$ sin $\pi/W$ nqR thus obtained is applied to an accumulator 33. Since the memory address control unit 29 operates synchronously with the accumulator 25, the harmonic amplitude coefficients $C_n$ which are sequentially read out for respective harmonics are multiplied with corresponding harmonic sinusoidal wave amplitude values sin $\pi/W$ nqR respectively thereby individually setting the amplitude values $F_n$ of respective harmonics. The accumulator 33 operates to sequentially accumulates the amplitude values $F_n$ of respective harmonics produced by the harmonic amplitude multiplier 32. When a computation interval timing signal $t_x$ is produced by counter 14, a gate circuit 34 is enabled to supply the accumulated value (representing the amplitude value at a sampling point of the musical tone waveform) produced by the accumulator 33 to a D-A converter 35. In response to the timing signal $t_x$ the accumulator 33 is reset to prepare for the next accumulating operation of the amplitude value at the next sampling point. Consequently, the amplitude values (digital signals) at successive sampling points of a musical tone waveform which is set by the harmonic amplitude coefficient $C_n$ are applied to the D-A converter 35 with a period corresponding to the tone pitch of a depressed key each time a computation interval timing signal $t_x$ is generated. The digital amplitude values are converted into analogue signals which are supplied to a sound system 36, thereby producing a musical tone having a tone pitch corresponding to the depressed key and a color corresponding to the harmonic amplitude coefficient $C_n$ stored in the harmonic coefficient memory device 30.

An amplitude envelope is applied to the generated musical tone in the following manner. More particularly, the sound system 36 is provided with an envelope waveform generator which is started by key-on signal KON produced by the key switch circuit 11 when either one of the keys is depressed. The envelope waveform generated by the envelope waveform generator is multiplied with a musical tone signal to apply thereto such amplitude envelopes as the attack, sustain, decay, etc.

In the electronic musical instrument constructed as above described, when a certain key of the keyboard is depressed, a key switch of the key switch circuit 11 corresponding to the depressed key is closed to produce a signal "1" on a corresponding output line of the key switch circuit 11. The output signal produced by the key switch circuit 11 addresses the frequency number memory device 12 to read out a logarithmic frequency number log R corresponding to the tone pitch of the depressed key. The counter 16 counts the number of clock pulses $t_c$ to successively produce the harmonic order signals (1–W) and the order number memory device 17 is addressed by these harmonic order signals n to sequentially generate the logarithmic order numbers log N ($n_1$–$n_W$). At this time, since the harmonic order signals n produced by the counter 16 varies successively as $n_1, n_2 \ldots n_W, n_1 \ldots$ with the timing of the clock pulse $t_c$, logarithmic order numbers log $n_1$, log $n_2$, . . . , log $n_W$ are repeatedly read out from the order number memory device 17 each time the computation interval timing signal $t_x$ is generated.

The logarithmic frequency number log R and the logarithmic order number log n are added together by the adder 19 and the sum log n·R is applied to the logarithm-to-natural number converter 20. The logarithm-to-natural number converter 20 converts the sum log n·R applied thereto to natural number nR and repeatedly produces signal nR which vary successively as $n_1R, n_2R, n_3R, \ldots, n_WR$ with the timing of the clock pulse $t_c$. This signal nR is added to the output qnR of the shift register 23 by the adder 24 and the sum is applied to the first stage of the shift register 23 and sequentially shifted by the clock pulse $t_c$. At the initial state, the counts of respective stages of the shift register 23 are all zero so that when the first computation interval timing signal $t_{x1}$ is applied, the output signal nR of the logarithm-to-natural number converter 20 is stored in respective stages as $n_1R, n_2R, n_3R, \ldots, n_WR$ without any change. When the second computation interval timing signal $t_{x2}$ is applied, the shift register 23 sequentially produces accumulated values $qn_1R, qn_2R, qn_3R, \ldots, qn_WR$, where $q=1$ and the accumulated value qnR ($q=1$) of the shift register 23 and the output signal nR of the logarithm-to-natural number converter 20 are added together by the adder 24 and their sum nR+1nR (2nR) is applied to the input terminal of the shift register 23. Accordingly, the counts of respective stages of the shift register 23 become $2n_1R, 2n_2R, 2n_3R, \ldots, 2n_WR$ and these counts are successively produced by the shift register 23 with the timing of the clock pulse $t_c$ during the interval of the next computation interval timing signal $t_{x3}$. By repeating this operation the accumulator 25 (shift register 23) sequentially produces accumulated value qnR for generating the sinusoidal wave amplitude value sin $\pi/W$ nqR of each harmonic at successive sampling points (corresponding to qR) of the musical tone waveform. After being converted by an address signal by the memory address decoder 26 the accumulated value qnR of the accumulator 25 is used to address the sinusoid table 27 to read out sinusoidal wave amplitude values sin $\pi/W$ nqR ($n=n_1$–$n_{16}$) of respective harmonics at successive sampling points of the musical tone waveform. These sinusoidal wave amplitude values sin $\pi/W$ nqR of respective harmonics are multiplied with the harmonic amplitude coefficients $C_n$ supplied from the harmonic coefficient memory device 30 by the harmonic amplitude multiplier 32 to set the amplitude values of respective harmonics, and the amplitude values thus set are accumulated by the accumulator 33. The accumulated values $$\sum_{n=1}^{W} F_n$$

at respective computation interval timing signal $t_x$, that is, the amplitude values $F_n$ of respective harmonics at successive sampling points of the musical tone waveform are synthesized and sent out through the gate circuit 34. The amplitude values at successive sampling points of the musical tone waveform of the digital signals which are sequentially produced through the gate circuit 34 in synchronism with the computation interval timing signal $t_x$ are converted into analogue musical tone signals by the D-A converter 35, then imparted with amplitude envelope by the sound system 36 and finally produced as a musical tone.

Where the values of n are selected to be $n_1=1.0$, $n_2=2.0$, $n_3=3.0, \ldots, n_{16}=16.0$ so that the logarithmic order numbers log n (i.e. log $n_1$–log $n_W$) stored in the addresses of the order number memory device 17 will have a relationship of integer multiples. The accumulated values $qn_1R$, $qn_2R, \ldots, qn_{16}R$ which are sequentially produced by the accumulator 25 at respective harmonic orders would become q·1R, q·2R, . . . , q·16R respectively with the result that the sinusoidal wave amplitude values of respective harmonics produced by the sinusoid table 27 would become sin $\pi$/W·qR (the first harmonic), sin $\pi$/W·2qR (the second harmonic), . . . , sin $\pi$/W·16qR (the 16th harmonic). For this reason, the period of respective harmonics will have the relationship of interger multiples, that is the harmonic relationship thereby producing harmonic musical tones by the sound system.

A case wherein a non-harmonic musical tone is generated by the electronic musical instrument constructed as above described will be described hereunder.

For this purpose, the relationship between the logarithmic order numbers log $n_1$–log $n_W$ which are stored in respective addresses of the order number memory device 17 is more or less shifted from the harmonic relationship. Thus for example these logarithmic order numbers are made to be $n_1=1.0$, $n_2=2.001$, $n_3=3.002, \ldots, n_{16}=16.016$.

In this manner, when logarithmic order numbers log n′ which are not in the integer multiple relationship are stored in the order number memory device 17 the accumulated values $qn'_1R$, $qn'_2R, \ldots, qn'_{16}R$ sequentially produced by the accumulator 25 would become q·1R, q·2.001R, q·3.002R, . . . , q·16.016R respectively so that the relationship among respective accumulated values qn′R would become different from interger multiple relationship. Consequently, the sinusoidal wave amplitude values of respective harmonics read out from the sinusoid table 27 by the output produced by the memory address decoder 26 which converts the accumulated values qn′R into address signals would become sin $\pi$/W qR (the first higher harmonic), sin $\pi$/W·2.001qR (the second harmonic), sin $\pi$/W·3.002qR (the third harmonic), . . . , sin $\pi$/W·16.016qR (the 16th harmonic). Consequently, the periods of respective harmonics would have values corresponding to the logarithmic order numbers log n′ which are stored in respective addresses of the order number memory device 17 with the result that the sound system 26 would produce non-harmonic musical sounds having a relationship slightly shifted from the harmonic relationship.

As above described, with the electronic musical instrument of this invention, at first a multiplication product nR ($n_1R$–$n_WR$) of a frequency number R and a harmonic order number n is obtained (actually, a logarithmic frequency number log R and a logarithmic order number log n are added together and the sum log nR is converted into a product nR by a logarithm-to-natural number converter), the product nR is sequentially accumulated for respective order numbers to obtain an accumulated values, so that it is possible to readily generate harmonic or nonharmonic musical tone by producing the harmonic order numbers $n_1$–$n_W$ (log $n_1$–log $n_W$) with an interger multiple relationship or a relationship slightly different therefrom.

Figure 2:
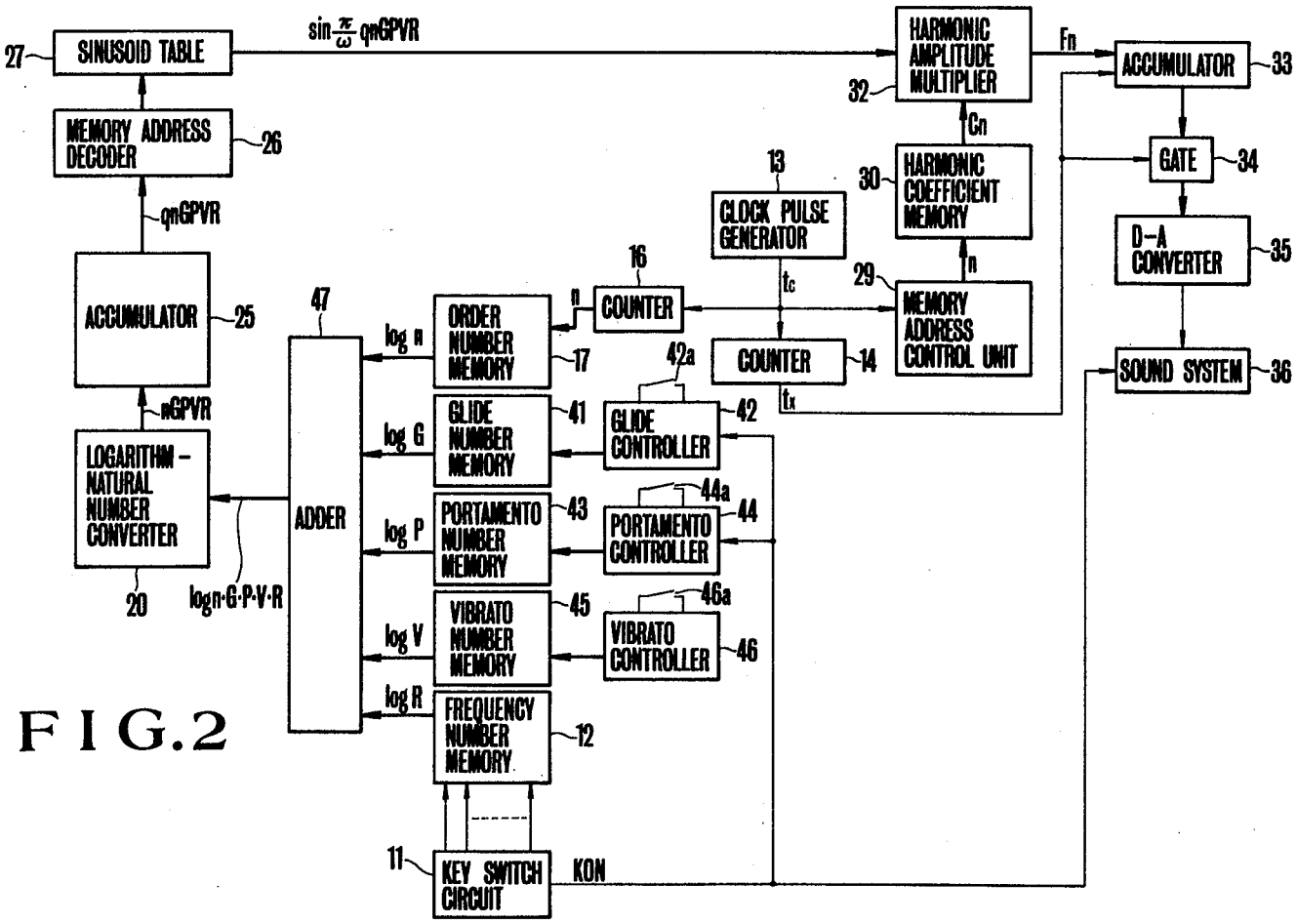
FIG. 2 is a block diagram showing a modified embodiment of this invention.
Figure 3A:
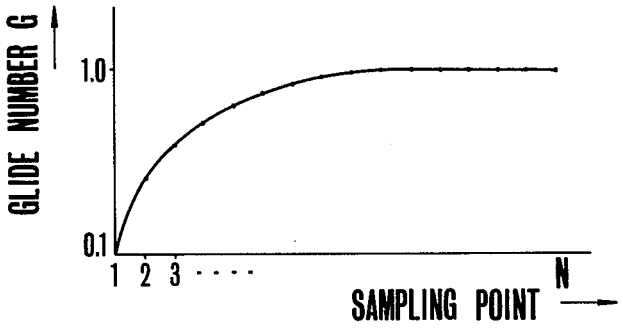
FIG. 3A, 3B and 3C show waveforms stored in glide, portamento, vibrato number memory devices respectively and useful to explain the operation of this invention.
Figure 3B:
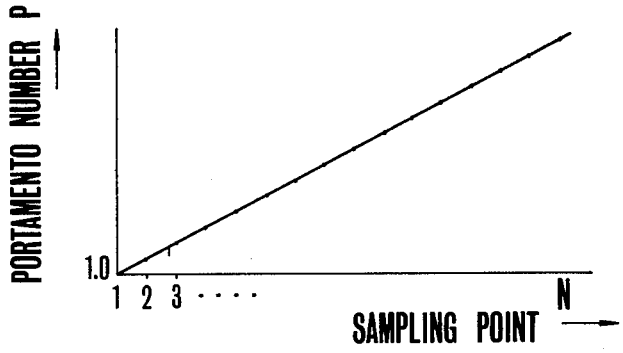
Figure 3C:
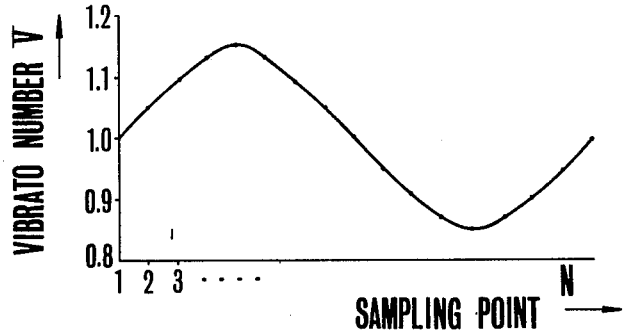

FIG. 2 is a block diagram showing a modified embodiment of this invention in which the same elements as those shown in FIG. 1 are designated by the same reference characters. There are provided a glide number memory device 41 having addresses storing logarithmic glide numbers log G corresponding to the sampling point values G of a glide waveform, said values G gradually increasing to a definite value 1.0 from a small initial value as shown in FIG. 3A, and a glide controller 42 which controls the reading out operation of the logarithmic glide numbers which have been stored in respective addresses of the glide number memory device 41. When a glide selection switch **42*a* provided for the glide controller 42 is closed the glide controller is started to operate by a key-on signal KON produced by the key switch circuit 11 to read out for one period the logarithmic glide numbers log G stored in the glide number memory device 41. There are also provided a portamento number memory device having addresses storing logarithmic portamento numbers log P corresponding to respective sampling point values P of a desired portamento waveform which increase linearly as shown in FIG. 3B, and a portamento controller 44 which controls the reading out operation of the logarithmic portamento numbers log P which have been stored in the respective addresses of the portamento number memory device 43. When a portamento switch 44*a* provided for the portamento controller 44 is closed, the portamento controller 44 starts to operate in response to the key-on signal KON generated by the key switch circuit 11 to read out for one period the logarithmic portamento numbers log P stored in the addresses of the portamento number memory device. Further, there are provided a vibrato number memory device 45 having addresses storing logarithmic vibrato numbers log V corresponding to respective sampling point values V of a vibrato waveform having a sinusoidal waveform as shown in FIG. 3C and a vibrato controller 46 which controls the reading operation of the logarithmic vibrator numbers log V stored in the addresses of the vibrator number memory device 45. Wnen a vibrato selection switch 46*a* provided for the vibrato controller is closed, the logarithmic vibrator numbers log V stored in the addresses of the vibrato number memory device 45 are sequentially and repeatedly read out. The glide number memory device 41, the portament number memory device 43 and the vibrato number memory device 45 are constructed such that they produce log 1=0 when the glide selection switch 42*a*, the portamento selection switch 44*a* and the vibrato selection switch 46*a* are OFF. An adder 47 is provided to add together a logarithmic order number log n produced by the order number memory device 17, a logarithmic order number log G produced by the glide number memory device 41, a logarithmic portamento number log P produced by the portamento number memory device 43 and a logarithmic vibrato number log V produced by the vibrato number memory device 45 for applying a sum signal log n·G·P·V·R to a logarithm-natural number converter 20**.

With the electronic musical instrument described above, to provide only the glide control, the glide selection switch 42a of the glide controller 42 is closed while the portamento selection switch 44a and the vibrato selection switch 46a of portamento controller 44 and the vibrato controller 46 respectively are maintained OFF. Accordingly, the portamento memory device 43 and the vibrato number memory device 45 continuously produce a logarithmic portamento number log P=0 and a logarithmic vibrato number log V=0 as above described. Under these conditions, when a key of the keyboard is depressed a key switch corresponding to the depressed key is closed to produce a signal "1" on a corresponding output line of the key switch circuit 11 and a key-on signal KON which shows that either one of the keys has been depressed. The output signal of the frequency number memory device 12 is used to address the frequency number memory device 12 to read out therefrom a logarithmic frequency number log R corresponding to the tone pitch of the depressed key. On the other hand, the counter 16 counts the number of the clock pulses $t_c$ to produce a harmonic order signal n, and the other number memory device 17 is addressed by the harmonic order signal n to successively produce logarithmic order numbers log n corresponding to respective harmonics. The glide controller 42 whose glide selection switch 42a has been closed operates in response to the building up of the key-on signal KON to address the glide number memory device 41 at a predetermined speed to read out for one period the logarithmic glide number log G corresponding to the glide waveform shown in FIG. 3A.

The logarithmic frequency number log R, the logarithmic order number log n, the logarithmic glide number log G, the logrithmic portamento number log P and the logarithmic vibrato number log V produced as above described are added together by adder 43 and the sum log n·G·P·V·R is applied to the logarithm-to-natural number converter 20.

Consequently, the accumulated value of the accumulator 25 becomes "qnGR", while the sinusoid table 27 produces sinusoidal wave amplitude values sin $\pi$/W qnGR of respective harmonics having a period corresponding to the accumulated value qnGR in the same manner as in the electronic musical instrument shown in FIG. 1. At this time, the glide number memory device 41 produces a logarithmic glide numbers log G corresponding to the sampling point amplitude values G (FIG. 3A) of a glide waveform which gradually approaches [1] from a value less than a radix point in synchronism with the commencement of the depression of a key, so that the value of the output signal GnR of the logarithm-natural number converter 20 varies accordingly. As a result, the tone pitch of the musical tone generated by the sound system at the time of commencement of the key depression decreases and then gradually increases to a predetermined pitch. Thus a musical tone imparted with a glide effect is generated.

When the portamento selection switch 44a alone of the portamento controller 44 is closed, the portamento controller 44 operates in response to the generation of the key-on signal KON in the same manner as in the case of glide control to sequentially read out the logarithmic portamento numbers log P corresponding to the amplitude values at respective sampling points of the portamento waveform (FIG. 3B) and have been stored in the addresses of the portamento number memory device 43. As a consequence, the logarithm-natural member converter 20 supplied with the output log n·R·R of the adder 47 produces an output signal [nPR] so that the sound system 36 produces a musical tone imparted with a portamento effect wherein the pitch increases corresponding to the gradually increasing signal P (portamento waveform). Where logarithmic portamento numbers log P which decrease gradually are stored in the addresses of the portamento number memory device 43, a musical tone imparted with a portamento effect wherein the pitch decreases gradually would be produced.

When the vibrato selection switch 46a of the vibrato controller 46 is closed, the vibrato controller operates to repeatedly read out with a predetermined period logarithmic vibrato numbers log V corresponding to respective amplitude values as respective sampling points of the vibrato waveform FIG. 3C and have been stored in the addresses of the vibrato number memory device 45. Accordingly, the value of the logarithmic vibrato number (log V) signal produced by the vibrato number memory device 45 varies periodically. Consequently the output signal of the adder 47 becomes log n·G·P·R and the logarithm-natural number converter 20 produces a signal nGVR which varies periodically in accordance with the vibrato waveform shown in FIG. 3C. Thus, the sound system 36 produces a musical tone imparted with a vibrato effect wherein the pitch of the generated musical tone varies periodically.

As above described, by generating the frequency number R, harmonic order number n, and various pitch control signals such as the glide number G, portamento number P and the vibrato number V in the form of a corresponding logarithms it becomes possible to perform complicated arithmetic operations which are necessary to effect various pitch controls of the generated musical tone with a simple adder instead of a multiplier.

While in the foregoing description memory devices were utilized for the purpose of generating the logarithmic frequency number R, the logarithmic harmonic order number n, the logarithmic glide number G, the logarithmic portamento number P and the logarithmic vibrato number V, it should be understood that the invention is not limited to this specific construction and that any other suitable means may be used for the purpose of generating logrithmic signals.

As above described, according to the electronic musical instrument of the harmonic synthesizing type of this invention, a product nR of a frequency number corresponding to a depressed key and a harmonic order number n is produced, and the product nR is sequentially accumulated for each harmonic order so as to form an accumulated value qnR which is used to read out from a sinusoid table device sinusoidal wave amplitude values of respective higher harmonic waves at successive sampling points of the generated musical tone so that by generating harmonic order numbers n (i.e. $n_1$–$n_W$) in a relationship of an integer multiple or in a relationship slightly different therefrom it becomes possible to readily generate harmonic or non-harmonic musical tones. Furthermore, according to this invention, the frequency number R, the harmonic order number which are used to set the pitch of the musical tone, and various musical tone pitch control signals such as the glide number G, portamento number P and the vibrato number V are converted into corresponding logarithmic signals, these logarithmic signals are added together, and the sum is converted into a natural number to obtain an accumulated value qnGPVR for each harmonic order so taat there is an advantage of that it is possible to perform the arithmetic operations for controlling the pitch of the musical tone by simple addition operations.

It will be clear that although the invention has been described in terms of its preferred embodiments, the invention is not limited to these embodiments.

What is claimed is:

1. In an electronic musical instrument of the harmonic wave synthesizing type wherein the harmonic components of a musical tone are generated, the harmonic components are multiplied with corresponding amplitude coefficients respectively, and the multiplication products are added together to synthesize the musical tone, the improvement which comprises a plurality of key switches for determining the pitch of the musical tone, frequency number generating means which generates a frequency number corresponding to a designated key switch, harmonic order number generating means which generates a harmonic order number representing the order of each harmonic component, an arithmetic processing means capable of multiplying integral and non-integral factors to obtain a multiplication product of said frequency number and said harmonic order number, accumulating means for repeatedly accumulating the output of said arithmetic processing means for respective harmonic orders at a predetermined speed, and sine function generating means including a memory device which stores the amplitude values at respective sampling points of a sinusoidal wave for generating said amplitude values of the sinusoidal wave corresponding to respective ones of said harmonic components in response to the accumulated values of respective harmonic orders produced by said accumulating means, thereby producing said harmonic components.

2. An electrical musical instrument according to claim 1 wherein said frequency number and said harmonic order number are logarithms and said arithmetic processing means includes an adder which adds together said logarithms and a logarithm-to-natural number converter which converts the output of said adder into a natural number.

3. The electronic musical instrument according to claim 2 which further comprises a logarithmic tone pitch control signal generator which generates a logarithmic tone pitch control signal, and wherein said adder of said arithmetic processing means operates to add said tone pitch control signal to the sum of said logarithms of said frequency number and said harmonic order number.

* * * * *

UNITED STATES PATENT AND TRADEMARK OFFICE

CERTIFICATE OF CORRECTION

PATENT NO. : 4,215,614
DATED : Aug. 8, 1980
INVENTOR(S) : Masanobu Chibana

It is certified that error appears in the above—identified patent and that said Letters Patent is hereby corrected as shown below:

Col.2, line 6: change "sychronizing" to-- synthesizing---

Col. 9, line 32: Change "other" to-- order---

Col. 10, line 12: Change "n·R·R" to-- N·P·R---

Signed and Sealed this

*Fifteenth* Day of *December 1981*

[SEAL]

*Attest:*

GERALD J. MOSSINGHOFF

*Attesting Officer*

*Commissioner of Patents and Trademarks*